United States Patent [19]

Carter

[11] 4,247,494

[45] Jan. 27, 1981

[54] CASE PRIMING

[75] Inventor: George B. Carter, Lichfield, England

[73] Assignee: IMI Kynoch Limited, Birmingham, England

[21] Appl. No.: 932,293

[22] Filed: Aug. 8, 1978

[30] Foreign Application Priority Data

Aug. 16, 1977 [GB] United Kingdom ..... 34413/77
Aug. 16, 1977 [GB] United Kingdom ..... 34414/77
Mar. 22, 1978 [GB] United Kingdom ..... 11492/78

[51] Int. Cl.[3] ..... C06B 21/00

[52] U.S. Cl. ..... 264/3 R; 86/1 R; 102/204; 149/24; 149/26; 149/36

[58] Field of Search ..... 86/1, 32; 149/24, 26, 149/35, 105, 111; 264/3 R; 102/204

[56] References Cited

U.S. PATENT DOCUMENTS

| | | | |
|---|---|---|---|
| 3,726,182 | 4/1973 | Fichter | 264/3 R X |
| 3,963,544 | 6/1976 | Staba | 149/24 X |
| 3,983,149 | 9/1976 | Kenney | 149/24 X |

FOREIGN PATENT DOCUMENTS

| | | | |
|---|---|---|---|
| 29929 | 7/1922 | Denmark | 149/35 |

*Primary Examiner*—Leland A. Sebastian
*Attorney, Agent, or Firm*—Cushman, Darby & Cushman

[57] ABSTRACT

Production of styphnate and azide explosives in situ in explosive devices including both ammunition and detonators particularly, though not exclusively, involving formation of premixes of relatively insensitive materials.

12 Claims, 7 Drawing Figures

CASE PRIMING

PROCESS

Figure 1:
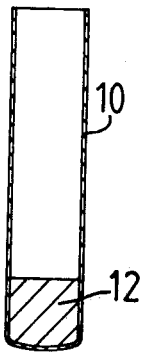

The present invention relates to methods of producing priming explosives.

In United States patent application Ser. No. 722,071 filed Sept. 3, 1976 described methods of producing explosive for priming explosive devices. The full disclosure of the prior specification is hereby incorporated in the present specification by reference, but for the sake of completeness herein the following paragraphs set out the main features of the prior specification insofar as they are relevant to the present developments.

The prior application provides a method (hereinafter referred to as the parent method) of producing explosive for priming explosive devices and employing any one of the following three features alone, or any combination of them:

1 said explosive is produced in a relatively small quantity, preferably appropriate to an individual utilisation demand, 2 said explosive is produced at a relatively low output rate, preferably not substantially greater than the rate at which it is used in priming, 3 production of said explosive is substantially continuous, or simultaneous with its further utilisation.

In the preferred embodiments of the parent method, the explosive is produced in situ in a utilising device. In the prior specification and in the present specification the following words have the meanings indicated:

Utilising device: refers to a combination of at least two elements of an explosive device, at least one of which elements is a body of said explosive. The combination will generally be such that in at least some subsequent operations, the combination can be handled by handling the other element or one of the other elements i.e. without handling the explosive itself. The other element may be a mere container or carrier for the explosive, such as a rimfire cartridge case, a cap shell for centrefire ammunition, whether sporting or military, the case of a detonator or delay device, or the bridge wires of a detonator. Many other suitable containers/carriers will occur to those skilled in the explosives art and the invention is therefore not limited to the examples listed here. The utilising device may be a finished explosive device, but it is more likely to be only partly finished; for example (a) further elements may have to be added to it to make up the explosive device, such as propellant and a bullet for a rimfire cartridge or an electric match or fuse for a detonator, and (b) the elements may have to be reshaped or relocated relative to each other as when priming composition in a rimfire cartridge case is forced into the rim of the case by a conventional spinning punch after explosive has formed in the head of the case or when a priming charge is pressed onto a detonator base charge.

Production in situ: means that the explosive is produced in relation to at least one other element so as to provide said combination. Where the other element is a container, the explosive will normally be produced within it. If the other element were a carrier, the explosive could be produced on the carrier or around a portion of the carrier. As indicated above, producing in situ does not imply that the combination is immediately ready for the final use.

Material: is used in a general sense,

Ingredient: is used to indicate a part of a composition in which the ingredients remain individually identifiable, Component: is used to indicate a material which can be combined with another component or other component to produce a further material in which none of the components is individually identifiable.

The explosive may be a compound formed by reaction of suitable components in a reaction medium. The compound may be formed in a composition which comprises some or all of the other ingredients of a priming composition. Preferably the components are insensitive relative to the explosive.

A component which is soluble in a reaction medium may be taken into solution by the medium and thereafter brought together with another component. Alternatively, the components and medium may be independent of each other before being brought together. Further, where components will not react dangerously in the absence of a medium, they may be brought together before being brought together with the medium.

Production of the explosive is preferably effected wholly in situ in a device. However, it is within the broad scope of the parent method to bring together materials away from another element of the device, and either to supply the formed explosive to the other element to form the device, or to supply the reacting materials to the other element for completion of formation of explosive in situ.

The examples of the parent method described in detail in our prior specification were intended particularly for use in priming of ammunition. It is now possible for us to state preferred features of the parent method for priming of both ammunition and detonators.

One difficulty associated with the extension of the parent method to detonator production arises from the relatively large quantity of primary explosive required for a detonator. For example, whereas a priming charge for a rimfire cartridge comprises only about 20 mg of a composition, which includes ingredients other than the primary explosive, a priming charge for a detonator commonly comprises 0.1 gm or more of a primary explosive such as lead azide. Thus, where the printing charge for the detonator is made by reaction of components in one reaction stage, difficulty may be experienced in ensuring that the components are brought into sufficiently intimate contact to produce the required quantity of explosive. This problem might be overcome by repeated reactions producing successive layers of priming explosive, but such a multiple stage process is commercially undesirable.

According to a first aspect of the present invention, therefore, there is provided a method of producing a primary explosive for a detonator by reaction of components in accordance with the parent method wherein the primary explosive is produced in a single reaction stage and wherein the components are mixed prior to and/or during the reaction so as to produce sufficient primary explosive to initiate secondary explosive. The secondary explosive may be a base charge of the detonator. Common base charge explosives are tetryl and PETN, although our invention is not limited to use with these secondary explosives.

Mixing may be achieved by mechanical mixing means and this may be found essential where components react in a slurry. However, in the preferred method according to the present invention, solutions of components are mixed. The solutions may be supplied in streams, and mixing may be achieved by merging of the streams. For example, each stream may issue from a nozzle, and the nozzles may be directed towards each other to cause the streams to merge. The merged streams may pass into a detonator case, or the streams may be merged therein.

Another difficulty which can arise in priming detonators by the parent method is treatment of any by-product of a reaction which produces the explosive. We have found that in priming of detonators with lead azide, a base charge can be initiated even if the product is not removed. However, it will be highly desirable to remove the by-product where (a) it is a diluent so that if left in situ it necessitates the use of a larger quantity of the primary explosive, and/or (b) it is hygroscopic or is liable to some process, eg undesirable decomposition during storage, which will detract from performance of the detonator.

According to a second aspect of the present invention, therefore, there is provided a method or producing a primary explosive for a detonator by reaction of components in accordance with the parent method wherein by-product of the reaction is removed in a solvent in which the primary explosive is relatively insoluble.

Preferably the solvent also provides the medium for the reaction, and the preferred solvent is water. The quantity of solvent available should be sufficient to take a significant proportion, and preferably all, of the by-product into solution. A portion of the solvent may have to be removed without by-product eg by drying.

Accordingly, in the preferred method according to the present invention, components are reacted in a medium to produce a primary explosive for a detonator by a method according to the parent invention, the components being so mixed as to produce in a single reaction stage sufficient primary explosive to initiate secondary explosive, the primary explosive being substantially insoluble in the reaction medium and precipitating therefrom and by-product of the reaction being soluble to a substantial degree in the reaction medium and being removed with the reaction medium. Preferably more than 90% by volume of the by-product is removed with the reaction medium.

The solution of the by-product may be removed by decanting or sucking it from a container, eg a detonator case, after the reaction has occurred and the primary explosive has precipitated. Preferably, the explosive is consolidated prior to decanting of the by-product solution, and this consolidation can be achieved by centrifuging.

Alternatively, the solution of by-product could be removed via a porous body leaving the precipitated primary explosive on the body as a pellet which could be charged into a detonator. The body itself may also be charged into the detonator as a carrier for the primary explosive, and the body may provide a part of the explosive charge of the detonator eg it may constitute the base charge or delay charge of the detonator, or part of either such charge.

Preferably the primary explosive is lead azide. The preferred component are lead nitrate and sodium azide. However, other reacting components may be used eg lead hypophosphite or lead acetate may be substituted for lead nitrate to produce lead salts. Barium azide may be used instead of sodium azide, but will be expensive relative to the sodium salt.

Where a base charge is used, the priming charge is preferably pressed into firm contact with the base charge.

It may be necessary to sensitize the main priming explosive to a flame produced by an initiator such as an electric match of the detonator. The flame sensitizer may be lead styphnate. The flame sensitizer can be produced in situ on or in the main priming charge. For example, where one of the components for production of the main priming charge is lead nitrate, an excess of lead nitrate over that required for the main priming charge may be provided, and sodium styphnate may be mixed with the other component required for the main priming charge or may be fed to the by-product solution after precipitation of the main priming.

Even in detonators, however, only small quantities of explosive are produced in situ in individual devices, and the quantities of individual components required to produce the explosive are clearly smaller still. This can introduce dosing problems. In accordance with a third aspect of the present invention therefore in a method of producing explosive by reaction of components in accordance with the parent method, the components are brought together in a premix in which they will not react because of the absence of a reaction medium but in a quantity which is large relative to the requirement for an individual priming charge. The premix may include all ingredients and components required to make a priming composition upon addition of a reaction medium thereto, the components and ingredients being present in such quantities and so intermixed that individual doses can be divided from the bulk mixture, each dose containing components and ingredients in the required proportions to produce a desired priming composition upon addition of the reaction medium to the individual doses. The premix may be in dry, powder form, and may be distributed between receivers, for example detonator or rimfire cases, or cap shells for centrefire ammunition, before addition of a reaction medium thereto. Mixing in the receiver is not essential.

As discussed in the United States patent application previously identified, the priming operation can be automated. Generally known types of powder dosing machinery may be used to distribute bulk premix between containers. However, distribution of the dry premix may be effected by conventional equipment for distributing dry priming composition. Since conventional dry priming operations do not involve dosing a liquid it will still be necessary to provide a suitable device for dispensing predetermined quantities of reaction medium, preferably water, to the individual receivers. Either the powder or liquid can be fed into the receiver first. The premix may also include a binder, or this may be included in the liquid dose. The latter may also contain a small quantity of surfactant to promote distribution of the reaction medium through the powder.

In the third aspect of the present invention a dry premix may comprise styphnic acid powder and a powder of a basic lead compound which will react with the acid in the presence of a suitable reaction medium to produce lead styphnate. For convenience, this premix is referred to herein after as the AB (acid-base) premix. The powders may be intimately mixed so that on addition of a reaction medium they will react substantially completely.

Any form of styphnic acid may be used in an AB premix. For example, the acid may be of the purified kind (some forms of which are referred to in U.S. Pat. Nos. 3,983,149 and 4,029,530). Alternatively, the acid could be of the relatively impure variety e.g. as referred to in U.S. Pat. Nos. 2,150,653 and 2,246,963. The acid could also be made by newer techniques such as those described in U.K. Pat. No. 1,278,576.

The lead compound could be selected to avoid production of contaminants in the priming material or to produce easily removable contaminants for example water or gas. A particularly suitable compound is lead oxide whether in the form of litharge or massicot. Alternatives are lead hydroxide and basic or normal lead carbonate.

The acid and lead compound may be mixed in stoichiometric proportions to produce said styphnate.

The AB premix may include additional ingredients required to make a complete priming composition. The additional ingredients should not interfere with the acid/base reaction to an unacceptable degree. We have established, however, that it is possible to make virtually any of the standard lead styphnate priming compositions by means of an AB premix. For example, suitable additional ingredients include:

- oxidisers: barium nitrate, lead peroxide, lead nitrate, potassium chlorate (unless the priming composition is required for ammunition where chlorates are undesirable);
- frictionators: powdered glass, powdered carbon, grit;
- sensitisers: tetrazene, lead trinitrophloroglucinate;
- fuels/spark producers: antimony sulphide, calcium silicide, metal powders;
- flame improvers/gas generators: nitrobodies e.g. tetryl, PETN;
- binders: gum arabic; polyvinyl alcohol;
- surfactants: lissapol.

As indicated above, these additional ingredients may be incorporated in the premix in well known proportions to produce standard priming compositions after substantially complete reaction of the acid/base to produce lead styphnate. There may be a degree of interference with the main reaction, however. For example, barium nitrate may react with styphnic acid to a small degree to produce barium styphnate. Since this is itself a priming explosive, it clearly presents no problems. Even where a side reaction does reduce the formation of explosive material, however, it will be acceptable provided it does not produce a substantial proportion of by-product in the final product.

For priming of ammunition, including both sporting and military ammunition of the rimfire and centrefire types, an AB premix for forming priming composition preferably contains sufficient styphnic acid and basic lead compound to produce lead styphnate as 20 to 50%wt of the priming composition. The required proportion of oxidiser in the composition depends upon the proportions of theother ingredients, e.g. whether or not a fuel is provided, and also upon the amount of oxygen available from the oxidiser: barium nitrate may be present as 10 to 60%wt, but equivalent quantities (in terms of oxygen yield) of other oxidisers may be used. Glass may provide up to 50%wt of the composition, being generally omitted from compositions for centrefire ammunition and usually present as about 20–40%wt of rimfire priming compositions. Tetrazene may provide up to 5%wt. In some compositions, fuels such as antimony sulphide, calcium silicide and aluminium powder may provide a high proportion, say up to 70%wt, of the composition.

The use of a premix is not limited to ammunition priming or to production of lead styphnate. Premixes can be used in production of other explosive devices, such as detonators and delay devices e.g. explosive trains, and also in production of other explosives, such as azides. Azides will generally be produced by double decomposition reactions since the corresponding acid (hydrazoic) is extremely unpleasant material to handle and use. A suitable double decomposition reaction is barium azide with lead nitrate, both of which materials can be provided in dry powder form. The barium nitrate by-product will function as an oxidiser if retained in the composition. Other reactions suitable for forming lead azide are described in United States Patent application previously identified and all of them can be used in premix techniques.

A premix can also be used to form two explosives simultaneously. For example, an AB premix may also include components referred to above for production of lead azide.

One problem which can arise in the formation of a premix suitable for producing a composition is the incorporation therein of already formed sensitive ingredients of the composition e.g. tetrazene. In accordance with a fourth aspect of the present invention, therefore, where a sensitive ingredient, e.g. tetrazene is to be included in a dry mix, (which may be a premix as described above) it is first mixed wet with at least one but not all of the other materials of the dry mix and the wet mix containing the sensitive ingredient is then dried, and powdered if necessary, before being mixed dry with the remainder of the dry mix. One material in the wet mix may be a frictionator. If the sensitive ingredient is mixed wet with a plurality of the other materials of the dry mix the plurality preferably does not react in this wet mixing stage or at least does not react dangerously.

By way of example, embodiments of processes in accordance with various aspects of this invention will now be described in detail.

The first embodiment to be described is for use in priming of 0.22 rimfire cartridges with a priming composition comprising lead styphnate, an oxidiser, a frictionator and a sensitizer. The process involves the production of a dry AB premix of the following materials and proportions by weight:

| | |
|---|---|
| styphnic acid | 20–23% |
| lead monoxide | 19–21% |
| barium nitrate | 19–21% oxidiser |
| tetrazene | 3–4% sensitizer |
| glass | 31–39% frictionator |

Since the tetrazene is itself a sensitive explosive, it is first mixed wet with the glass and lead oxide. The resulting tetrazene/glass mixture is dried and forms a "cake" which can be safely powdered. This powder can be mixed dry with the other materials listed above.

The premix is prepared in any convenient batch size which will depend to some extent on the size of the priming charge. A quantity of 200–250 grams has been found satisfactory for priming charges of approximately 20 milligrams per case. However, substantially smaller batches, say 20–50 grams, may be found useful in some circumstances and much larger batches may be found suitable in other circumstances.

The premix is distributed between cartridge cases by conventional priming apparatus, which will be described only briefly. The basic equipment comprises three priming plates having the same number of holes arranged in the same pattern in each plate. One of these plates is superimposed directly on another, and these two plates are relatively movable so that their holes can be brought into and out of alignment with each other. The third plate can receive rimfire cartridge cases and can be arranged below the other two plates with its holes (containing the cases) in alignment with the holes in the intermediate plate.

A quantity of premix is raked over the uppermost plate while its holes are out of register with those of the intermediate plate. Accordingly, the holes in the top plate are filled with the premix, and act as volumetric measuring devices. The upper surface of the plate is then raked clean, leaving the holes accurately filled. The top plate is then moved to bring its holes into register with those of the intermediate plate, and the premix falls through the holes in the intermediate plate into the cartridge cases below.

Each cartridge case receives a dose of about 3 μl of water. This may be provided in the case before or after the dose of premix is provided. In either event, the water provides a reaction medium to enable the styphnic acid and lead oxide to react in situ to produce lead styphnate. Assuming approximately complete reaction of the styphnic acid and lead oxide, this will produce a priming composition containing about 39–44% lead styphnate. The cases containing the wet composition can be passed immediately to a conventional spin punch which spins the priming composition into the rim of the case.

Primed cases are now passed to a conventional drying oven in which the water is driven off. Total time elapsed between bringing together of the water and the premix and passing of the primed cases to the drying oven should be sufficient to enable maximum possible reaction of the styphnic acid and lead oxide. Spinning may occur at any intermediate time, since the reaction may occur partly in the rim of the cartridge case. After drying the cases may be passed for loading of propellant and insertion of the bullet in accordance with conventional techniques.

As outlined in the United States patent application previously identified, we prefer to use the parent method and its developments to enable automation of a priming process. The AB premix disclosed above is suitable for this. The bulk premix can be fed to a powder dosing machine which will automatically feed powder doses of the required size to individual cartridge cases. However, the technique described in detail above is a convenient way of combining the parent method with conventional equipment and processes.

In both the parent method and the developments described herein, we prefer to produce the explosive in small quantities appropriate to individual priming charges. However, the parent method is not limited to this feature, and the premix technique can be advantageously applied to a priming technique in accordance with the parent method in which explosive sufficient for a plurality of charges is made simultaneously. Thus a body of a premix sufficient for a plurality of charges may be combined with water to produce a wet priming composition which can then be distributed between cartridge cases in accordance with conventional wet priming techniques. Thus, only the premix would be handled outside the priming cubicle, and since the premix is only a pyrotechnic composition, its handling would be relatively easy compared with handling of a primary explosive such as lead styphnate. Quantities of wet priming composition of a size similar to those supplied to priming cubicles in conventional priming operations, say one pound of composition, could be produced by this process.

Where relatively large quantities of water are to be supplied to the premix, the tetrazene may be omitted from the dry premix and may be supplied as a suspension in the water dose. This is true even where the explosive is to be produced in individual doses of priming composition in the case; for example, if 20 μl of water were supplied to the case instead of 3 μl, the tetrazene could be included in the water dose, but the additional water would then have to be driven off before spinning of the composition.

The second embodiment to be described is concerned with priming of capshells for centrefire ammunition. The following dry AB premix is prepared, the proportions being by weight:

| | | |
|---|---|---|
| styphnic acid | 19 to 21% | |
| lead monoxide | 17 to 19% | |
| barium nitrate | 35 to 43% | oxidisers |
| lead dioxide | 4½ to 5½% | oxidisers |
| Calcium silicide | 10½ to 11½% | fuels |
| Antimony sulphide | 4½ to 5½% | fuels |
| Tetrazene | 1½ to 2½% | sensitiser |

The dry premix is dosed into capshells in the same way as the rimfire premix in the first embodiment. Each capshell is then dosed with water and the acid reacts with the oxide to produce about 34 to 40%wt lead styphnate in the composition. There are now two possibilities for further handling of the shells, either -

(a) the composition can be dried in the shell after the reaction has been completed, and the shells can then be treated as conventionally primed shells for assembly into battery pockets which are then assembled with other cartridge components, or (b) the shells containing the still wet composition can be assembled with cap chambers to form battery pockets, and the composition can be dried out after such assembly. The moisture leaves the pocket via the flash holes in the capchamber.

The latter technique carries the additional advantage that the composition in the capshell can be moulded to a required shape while it is in a wet, relatively plastic form. This facilitates the formation of a nip of required dimensions between the point of the anvil in the battery pocket and the base of the capshell. The moulding of composition in each shell can be effected by the anvil itself. These latter steps are of course available whether or not the explosive is actually formed in situ in the capshell and alternative priming techniques to take advantage of them will be described later with reference to FIGS. 6 and 7.

The third embodiment will be described with reference to the accompanying diagrammatic drawings (FIGS. 1 to 5) which show successive stages in the production of a primed detonator by a technique in accordance with the first and second aspects of the present invention.

FIG. 1 shows in section a detonator case 10 containing a base charge 12 of a conventional secondary explosive such as PETN or tetryl. The base charge may be provided in the detonator case by a conventional technique which forms no part of this invention.

Figure 2:
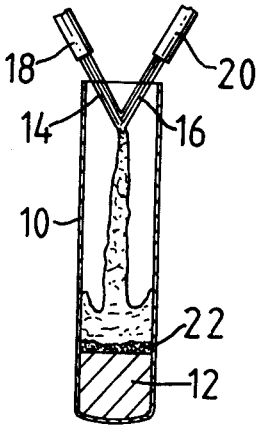

As shown in FIG. 2, the case 10 is fed to an injection station where it receives streams 14, 16 of reactant solutions from respective nozzles 18 and 20. The preferred reactants are lead nitrate and sodium azide, each in a water solution. The streams are caused to merge shortly after they leave the nozzles and as they pass into the case 10. The reactants are thus mixed by turbulence and/or diffusion in the merging streams. Since there is no mixing until the streams have left the nozzles, there is no danger of contamination of the nozzles with the lead azide.

Figure 3:
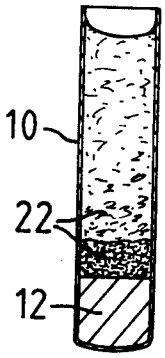

FIG. 3 shows the case containing the mixture of solutions, with a precipitate of lead azide at 22. This precipitate forms very shortly after the solutions have been fed into the case. . The case is now passed to a centrifuge (not shown) of a generally conventional type.

Figure 4:
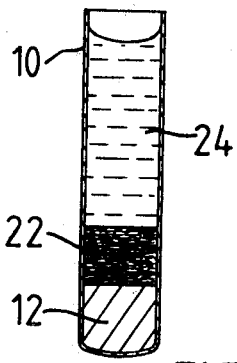

FIG. 4 shows the case after centrifuging with the lead azide precipitate 22 consolidated on the base charge 12. The liquor 24 remaining above the azide is a solution of the by-product—sodium nitrate.

Figure 5:
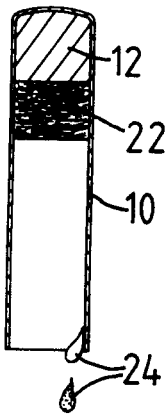

As shown in FIG. 5, the case is inverted to decant most of the by-product liquor, leaving the consolidated azide in firm contact with the base charge. The mouth of the case may be wiped before the case is passed to a drier (not shown) to drive off the remaining water.

It has been found that the greater part of the by-product can be removed by centrifuging and decanting as disclosed above, only an estimated 5% by weight of the priming charge being sodium nitrate. This can also be removed if desired by further treatment with water to dissolve the nitrate, centrifuging and repeated decanting.

When the primed case has been finally dried, the consolidated azide is preferably passed into firm contact with the base charge by conventional detonator production techniques which form no part of the present invention.

The sodium nitrate solution can be decanted into a tank containing a liquid which will destroy any lead azide particles carried along with the by-product. Detonators which have been detected as faulty can be rejected by dropping them into the same tank.

We have produced a number of primed detonators by the technique illustrated in the drawings using lead nitrate and sodium azide, each in water solution, as the reactants and 0.25 gm of PETN as the base charge. Some priming charges were pressed at 4,000 psi and others left unpressed. All pressed priming charges successfully initiated the base charge with as little as 0.09 gm of lead azide in the priming charge. Some difficulties were found with unpressed priming charges, and care is needed in drying such charges to avoid shrinkage of the priming and movement away from the base charge. In some instances, sodium styphnate was added to the sodium azide to produce lead styphnate as a flame sensitiser.

In an alternative technique to that shown in the drawings, components are reacted in a slurry, with only a relatively small quantity of water, e.g. just sufficient to enable reaction of the components to occur. In this technique, mechanical mixing is used to ensure that the the components come into reacting relationship. No attempt is made to remove by-product, the water being simply driven off after completion of the reaction.

This latter technique has been successfully operated using mixing of the components outside the aluminum detonator case, with the priming charge subsequently being loaded into the case over the base charge on which it is pressed at 4,000 psi. Both tetryl and PETN base charges have been successfully initiated with priming charges comprising about 0.46 gm of mixed lead azide and by-product. In this technique the primary explosive was made by reaction of sodium azide with lead nitrate and with lead hyphosphite. Some difficulties were experienced because of inadequate flame sensitivity of the primary explsoive, but these were dealt with by the addition of a lead nitrato-hypophosphite ignitor layer over the lead azide charge.

First and second aspects of the invention are not limited to details of the illustrated embodiment. Even where solutions of reactants are merged, as in the drawings, it is desirable to keep the concentrations of the solutions as high as possible while avoiding deposition from stored solution. Gentle heating of stored reactant may be used to avoid such deposition. While it is preferred to press the priming charge into contact with the base charge, this may be found unnecessary if an adhesive or retaining means is used to retain the priming charge in place as it dries. The rate of drying may then have to be controlled to minimise shrinkage. PETN or other nitrobody in a volatile solvent could be used as an adhesive to bond the priming charge to a PETN base charge as the priming dries.

Stirring of the mixture during reaction is highly desirable in slurry type priming where small quantities of water are used. At present such stirring has been effected only outside the detonator case, but a stirrer could be used to stir a slurry in a detonator case.

Substantially all of the by-product may be removed by repeated leaching with a suitable solvent, preferably water. Where some by-product is retained, it may be oxygen-balanced by treating the priming layer with a solution of a suitable nitrobody in a volatile solvent, for example acetone. PETN is a suitable nitrobody, and could be incorporated in the slurry where priming is used.

U.S. Pat. No. 3,340,808 describes a one-stage detonator in which the priming charge is mixed with the secondary explosive to avoid multiple loading operations. Such a detonator could be produced by a method in accordance with the present developments by pre-mixing the secondary explosive with the components of the priming explosive, and adding a suitable reaction medium to enable reaction of the components in the mixture.

Neither the present developments nor the parent method are limited to the production of rimfire and centrefire ammunition and detonators. For example, U.S. Pat. No. 4,024,818 to Calvin L. Scott and Howard S. Leopold describes stab-initiated explosive devices and a variety of explosives therefore. One such explosive comprises both styphnate and lead azide and this could be made by a modification of an AB premix to include components (e.g. barium azide and lead nitrate) enabling production of lead azide. We have not tested the alternative composition discussed by Scott and Leopold (and using mercuric -5-nitrotetrazole) in U.S. Pat. Nos. 3,965,951 and 4,024,818, but it is possible that these compositions can also be made by in situ techniques. Still further explosive devices using lead styphnate and/or lead azide are described in U.S. Pat. No. 3,188,914 and U.K. Pat. No. 1,513,065, and these also are suitable for the use of in situ techniques preferably using premixes. The invention can also be applied to production of "match heads" for detonators where the explosive is produced in a bead on carrier wires embedded in the bead. Yet another type of carrier/container for explosive is described in U.S. Pat. No. 3,132,585 which refers to a "priming sponge" for priming detonators. Priming explosive can be produced in situ in such a sponge for example by a reaction similar to that described in U.K. Pat. No. 301,166.

Nor are the parent method and the present developments limited to the dosing techniques which have been discussed above. For example, U.K. No. 1,201,565 discloses a method of slurry or suspension priming using finely divided ingredients in the composition, and both the parent method and the present developments can be applied to the techniques described in that specification, particularly but not exclusively to enable production of explosive continuously with its use in priming. The invention can also be used in forming extrudable compositions as described in U.S. Pat. No. 4,056,416. The invention can of course be used in production of relatively large primers such as those shown in U.S. Pat. No. 3,499,386.

Figure 6:
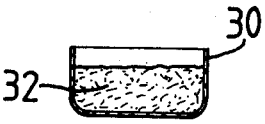

The premix technique can of course be applied to the continuous priming techniques described in the prior application, and the premix itself can also be produced continuously or in a series of small batches which are immediately distributed between receivers. Finally, reference is made to FIGS. 6 and 7 which illustrate diagrammatically the principles of a cap priming technique which provides the fifth aspect of the present invention. The capshell (or "cup") is shown at 30 and contains wet priming composition 32. The body of priming has a substantially level surface as seen in FIG. 6—this could be produced by an in situ technique such as that described in the second embodiment above or by a slurry priming technique in which wet priming containing preformed explosive is dosed into the capshell, or by wetting composition in a dry-primed capshell.

Figure 7:
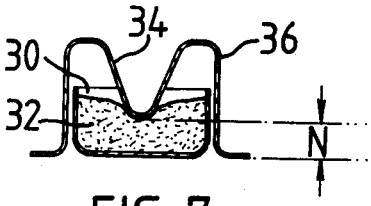

The wet priming is in a plastic mouldable form and is moulded while wet to produce the dimpled surface shown in the battery pocket in FIG. 7—thereby producing a predetermined nip N between the point of the anvil 34 and the base of the cap shell. Where the anvil is integral with cap chamber 36, as shown in the Figure the anvil itself can mould the composition. This is the preferred arrangement, moulding then being simultaneous with assembly of the battery pocket. This is not essential however as moulding can be separate from assembly. In either event, the composition is dried by driving off moisture via the flash holes of the cap chamber.

This fifth aspect of the present invention therefore provides (1) a method of priming cap shells comprising the step of forming a body of wet priming in each shell, moulding the priming to a desired shape while it is still wet and then drying the priming in that shape, and also (2) a method of priming cap shells comprising the step of forming a body of wet priming in each shell, assembling the cap shell into a battery pocket and drying the priming after assembly of said pocket.

The fifth aspect of the invention also provides cap shells so primed and also battery pockets including such cap shells. The anvils of the battery pockets are preferably integral with their respective cap chambers so that in each battery pocket the moulding step can be performed by the anvil during assembly of the pockets.

Although within its broad scope the parent invention, and hence the various aspects of the present invention, includes formation of a priming explosive in a preformed body of another explosive, it is mainly concerned with formation of priming explosive separate from other explosive which is subsequently assembled with the priming explosive to be ignited and/or initiated thereby. The word "initiated" throughout this specification refers to initiation of detonation.

I claim:

1. In a method of priming a plurality of explosive devices by incorporating a body of priming explosive comprising a primary explosive compound with an element of each device the improvement comprising dosing into each device a quantity of a substantially premix containing relatively insensitive components that will, in the presence of a liquid reaction medium, chemically react together forming said primary explosive compound and dosing into each element a quantity of said liquid reaction medium so as to cause said components to chemically react together thereby forming said primary explosive compound.

2. A method according to claim 22 wherein said premix is dosed into respective elements before said liquid reaction medium is added thereto.

3. A method according to claim 1 wherein the premix includes all ingredients and components required to make a priming explosive composition upon the addition of said reaction medium thereto.

4. A method according to claim 3 wherein said premix comprises an oxidiser, a sensitiser for said primary explosive compound, a frictionator and components which when reacted form said primary explosive compound.

5. A method according to claim 3 wherein said premix comprises an oxidiser, a sensitiser for said primary explosive compound, a fuel and components which when reacted form said primary explosive compound.

6. A method according to claim 4 or claim 5 wherein said sensitiser is tetrazene.

7. A method according to claim 5 wherein said fuel comprises calcium silicide.

8. A method according to claim 5 wherein said fuel comprises antimony sulphide.

9. A method according to claim 1 wherein said elements are rimfire cartridge cases.

10. A method according to claim 1 wherein said elements are centre-fire caps.

11. In a method of priming a plurality of explosive devices by incorporating a discrete body of priming explosive comprising a primary explosive compound with an element of each device, the improvement comprising forming each said body of priming explosive by providing a dose of a substantially dry premix comprising relatively insensitive components that will, in the presence of a liquid reaction medium, react together forming said primary explosive compound, and combining said dose of premix with a quantity of said reaction medium so as to cause said components to chemically react together thereby forming said discrete body comprising said primary explosive compound.

12. A method according to claim 11 wherein said premix contains all the ingredients and components required to make a priming explosive composition upon the addition of said reaction medium thereto.

* * * * *

UNITED STATES PATENT AND TRADEMARK OFFICE

CERTIFICATE OF CORRECTION

PATENT NO. : 4,247,494

DATED : January 27, 1981

INVENTOR(S) : George B. Carter

It is certified that error appears in the above—identified patent and that said Letters Patent is hereby corrected as shown below:

Claim 1, line 5, after "substantially" insert --dry--.

Claim 2, line 1, change "22" to --1--.

Signed and Sealed this

*Third* Day of *November 1981*

[SEAL]

*Attest:*

GERALD J. MOSSINGHOFF

*Attesting Officer*

*Commissioner of Patents and Trademarks*